United States Patent [19]

Schaeffler

[11] Patent Number: 4,602,409

[45] Date of Patent: Jul. 29, 1986

[54] METHOD FOR SECURING A FUNNEL-SHAPED GUIDE MEMBER IN A SELF-ADJUSTING HYDRAULIC TAPPET

[75] Inventor: Georg Schaeffler, Flughafenstr. 11, 8522 Herzogenaurach, Fed. Rep. of Germany

[73] Assignee: Motorenbau, Maschinen und Werkzeugfabrik Konstruktionen GmbH, Fed. Rep. of Germany

[21] Appl. No.: 699,858

[22] Filed: Feb. 8, 1985

[30] Foreign Application Priority Data

Mar. 31, 1984 [DE] Fed. Rep. of Germany ..... 3412153

[51] Int. Cl.[4] ..... B21K 1/20; B21D 39/00

[52] U.S. Cl. ..... 29/156.7 B; 29/510; 29/DIG. 48; 123/90.48

[58] Field of Search ..... 29/156.7 B, 510, 511, 29/DIG. 48; 123/90.48, 90.55, 90.56, 90.57, 90.58, 90.59

[56] References Cited

U.S. PATENT DOCUMENTS

| | | | |
|---|---|---|---|
| 2,144,147 | 1/1939 | Glassford | 29/156.7 B |
| 2,187,008 | 1/1940 | Baxter | 123/90.59 |
| 2,768,725 | 10/1956 | Foulds et al. | 29/511 X |
| 3,191,268 | 6/1965 | Matea | 29/511 X |
| 4,437,439 | 3/1984 | Speil | 123/90.56 |

*Primary Examiner*—Mark Rosenbaum
*Assistant Examiner*—Ronald S. Wallace
*Attorney, Agent, or Firm*—Bierman, Peroff & Muserlein

[57] ABSTRACT

A method of securing a funnel-shaped guide member in the bore wall of the cup-shaped casing of a self-adjusting hydraulic tappet for overhead camshaft internal combustion engines comprising first introducing a funnel-shaped guide member (2) into the bore of the cup-shaped casing (1) made of a ferrous material and being initially unhardened, the guide member (2) bearing on a shoulder (9) of the bore and then in any sequence:

(a) On that side of the guide member (2) which is opposite the shoulder (9), chiplessly forming material from the bore wall so as to bear sealingly on the guide member (2) and thus to locate the same relatively to the casing (1);

(b) Sealing the joint between the cup-shaped casing (1) and the funnel-shaped guide member (2) by welding or soldering.

3 Claims, 2 Drawing Figures

Figure 1:
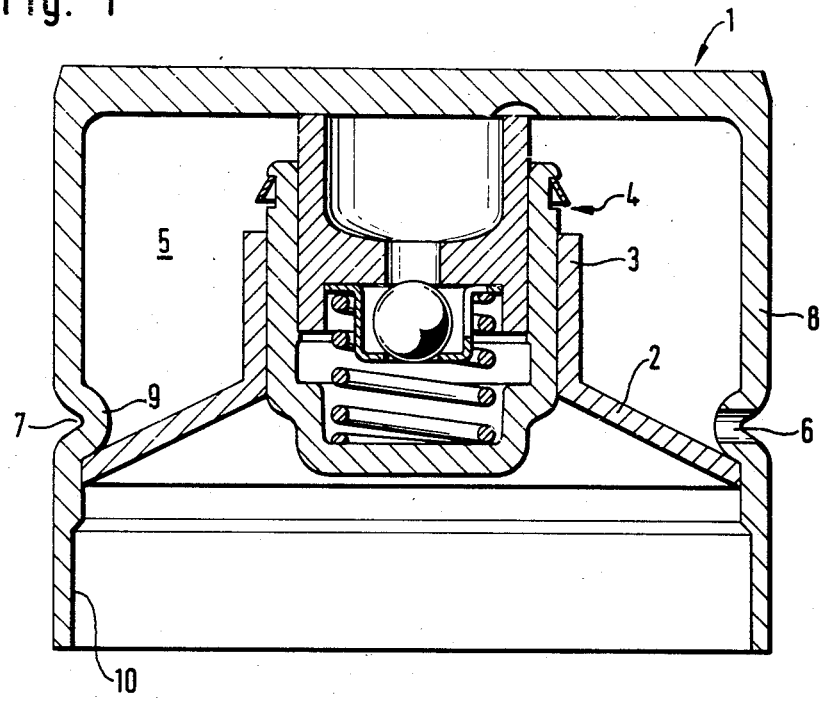

METHOD FOR SECURING A FUNNEL-SHAPED GUIDE MEMBER IN A SELF-ADJUSTING HYDRAULIC TAPPET

STATE OF THE ART

Different methods of securing a funnel-shaped guide member in the bore wall of the cup-shaped casing of a self-adjusting hydraulic tappet for overhead camshaft internal combustion engines are known. For example, the funnel-shaped guide member inserted in the casing bore has been connected to the bore wall by soldering or welding on its outside edge but the risk in this case is that vibratory stresses near the soldered or welded joint arising in operation may cause cracks and fractures which in the extreme case may lead to destruction of the tappet.

The funnel-shaped guide members have also been positively secured in the bore wall of the casing by the guide member being placed against a shoulder of the bore wall and by chipless forming on the opposite side of material from the bore wall, such material bearing on the guide member. Since the same also bounds an oil reservoir, the junction or joint must be liquid-tight. To this end, the securing has been provided by chipless deformation in the bore wall after the hardening of the casing, the same being made of a ferrous material. To be able to carry out chipless deformation of the bore wall, speciameasures were necessary at this place; for instance, the surface of the article had to be covered before carburization or the bore wall had to be given local annealing in this place after hardening. The reason for these steps was that, had they not been taken and had the guide member been secured in the bore wall by chipless deformation before the hardening of the casing, the joint would have been so impaired by the subsequent heat treatment that its sealing tightness would have been uncertain.

OBJECTS OF THE INVENTION

It is an object of the invention to provide a novel method such that, while avoiding expensive production steps, a connection can be provided between the funnel-shaped guide member and the cup-shaped casing which, in addition to being of adequate mechanical strength, remains reliably sealing-tight in all operating conditions despite vibratory loading.

This and other objects and advantages of the invention will become obvious from the following detailed description.

THE INVENTION

The novel method of the invention comprises first introducing the funnel-shaped guide member into the bore of the cup-shaped casing, the same being made of a ferrous material and being initially unhardened, the guide member bearing on a shoulder of the bore, whereafter and in any sequence:

(a) On that side of the guide member which is opposite the shoulder, chiplessly forming material from the bore wall so as to bear sealingly on the guide member and thus to locate the same positively relatively to the casing;

(b) and sealing the joint between the cup-shaped casing and the funnel-shaped guide member by welding or soldering.

The result of combining these two known features is that chipless deformation can proceed in the bore wall before hardening so that expensive production steps are avoided while the additional welding or soldering ensures not only that the joint has additional mechanical strength but also that it will remain reliably sealing-tight in the long term.

Material can be formed from the bore wall chiplessly in the form of a bead which extends over the entire periphery of the bore and which bears on the guide member. If it is important for the deforming forces to be very reduced to obviate the risk of possibly unwanted deformations of the casing or guide member, material can be formed from the bore wall only at discrete places of the periphery in the form of projections which also bear on the guide member.

Referring now to the FIGS.

Figure 2:
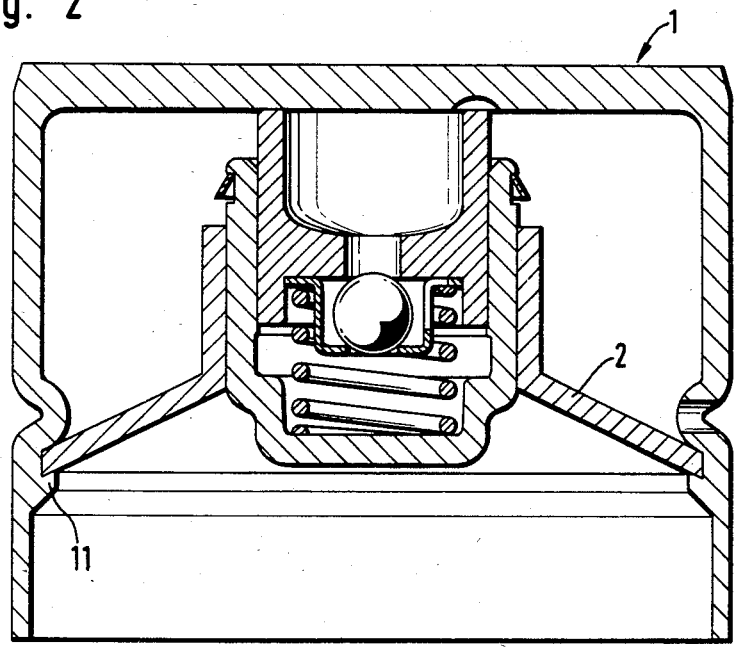

FIGS. 1 and 2 are longitudinal cross-sections of two steps of the casings formed by the method.

A valve tappet is formed by a cup-shaped casing 1 receiving a funnel-shaped guide member 2 which guides the actual hydraulic clearance-compensating element 4 longitudinally in a cylindrical collar 3. Casing 1 and member 2 bound an oil reservoir 5 supplied with oil from the engine lubricant circuit by a bore 6 in a peripheral groove 7 in a cylindrical wall 8 of casing 1.

FIG. 1 shows that funnel-shaped guide member 2 initially bears inside cylindrical wall 8 on a bead 9 which is the other side or reverse of groove 7 and towards the open end of casing 1, the bore wall is stepped to a larger diameter.

FIG. 2 shows that the insertion of a ram or the like (not shown) has displaced the bore material adjacent zone 10 towards guide member 2 so that the bore material comes to bear on guide member 2 in the form of a peripheral bead 11. In this stage, guide member 2 has been positively located relative to casing 1. Permanent sealing-tightness to oil is additionally provided by subsequent soldering or welding (not shown) in the joint area.

Various modifications of the method of the invention may be made without departing from the spirit or scope thereof and it is to be understood that the invention is intended to be limited only as defined in the appended claims.

What I claim is:

1. A method of securing a funnel shaped guide member in the bore wall of the cup-shaped casing of a self-adjusting hydraulic tappet for overhead camshaft internal combustion engines comprising first introducing a funnel shape guide member (2) into the bore of the cup-shaped casing (1) made of a ferrous material and being initially unhardened, the guide member (2) bearing on a shoulder (9) of the bore and then in any sequence:

(a) On that side of the guide member (2) which is opposite the shoulder (9), chiplessly forming material from the bore wall so as to bear sealingly on the guide member (2) and thus to locate the same relatively to the casing (1);

(b) Sealing the joint between the cup-shaped casing (1) and the funnel-shaped guide member (2) by welding or soldering.

2. A method of claim 1 wherein material is formed from the bore wall over the entire periphery of the bore in the form of a peripheral bead (11) which bears on the guide member(2).

3. A method of claim 1 wherein material is formed from the bore wall only at discrete places of the periphery in the form of projections which bear on the guide member (2).

* * * * *